US009303338B2

(12) United States Patent
Bertocchi et al.

(10) Patent No.: US 9,303,338 B2
(45) Date of Patent: Apr. 5, 2016

(54) WEFT-BRAKING DEVICE FOR YARN FEEDERS PROVIDED WITH A STATIONARY DRUM

(71) Applicant: L.G.L. ELECTRONICS S.P.A., Gandino (IT)

(72) Inventors: Giorgio Bertocchi, Leffe (IT); Giovanni Pedrini, Leffe (IT); Pietro Zenoni, Leffe (IT)

(73) Assignee: L.G.L. ELECTRONICS S.P.A. (IT)

( * ) Notice: Subject to any disclaimer, the term of this patent is extended or adjusted under 35 U.S.C. 154(b) by 79 days.

(21) Appl. No.: 13/724,622

(22) Filed: Dec. 21, 2012

(65) Prior Publication Data

US 2013/0167968 A1 Jul. 4, 2013

(30) Foreign Application Priority Data

Dec. 28, 2011 (IT) ..... TO2011A1217

(51) Int. Cl.
*D03D 47/34* (2006.01)
*B65H 51/22* (2006.01)
*D03D 47/36* (2006.01)

(52) U.S. Cl.
CPC ..... *D03D 47/347* (2013.01); *B65H 51/22* (2013.01); *D03D 47/364* (2013.01)

(58) Field of Classification Search
CPC ... B65H 51/22; D03D 47/347; D03D 47/364; D03D 47/366
See application file for complete search history.

(56) References Cited

U.S. PATENT DOCUMENTS

| | | | | |
|---|---|---|---|---|
| 5,316,051 | A * | 5/1994 | Zenoni et al. | 139/452 |
| 5,546,994 | A * | 8/1996 | Sarfati | 139/452 |
| 5,778,943 | A * | 7/1998 | Tholander | 139/452 |
| 6,257,516 | B1 * | 7/2001 | Fritzson et al. | 242/365.4 |
| 6,322,016 | B1 * | 11/2001 | Jacobsson et al. | 242/365.4 |

FOREIGN PATENT DOCUMENTS

| | | | |
|---|---|---|---|
| CN | 1139963 | A | 1/1997 |
| CN | 1149863 | A | 5/1997 |
| CN | 1470696 | A | 1/2004 |
| CN | 1847494 | A | 10/2006 |
| CN | 1986929 | A | 6/2007 |
| CN | 101160253 | A | 4/2008 |
| CN | 101713117 | A | 5/2010 |
| DE | 196332256 | C1 | 10/1997 |

(Continued)

OTHER PUBLICATIONS

Machine Translation of JP,10-13665 A, available at http://dossier1.ipdl.inpit.go.jp/AIPN/odse_top_dn.ipdl?N0000=7400.*

(Continued)

*Primary Examiner* — William E Dondero
(74) *Attorney, Agent, or Firm* — Cantor Colburn LLP

(57) ABSTRACT

The weft-braking device comprises a first annular plate coaxially supported in front of the delivery end of a stationary drum of a yarn feeder, and a second annular plate which is coaxially biased against the first annular plate by driving elements. The yarn is adapted to run between the annular plates in order to receive a braking action by friction. The driving elements comprise at least one piezoelectric actuator, which is deformable in response to a voltage applied thereto and has a movable operative end which is operatively connected to the second annular plate and a stationary operative end which is anchored to a stationary support.

15 Claims, 7 Drawing Sheets

(56) References Cited

FOREIGN PATENT DOCUMENTS

| | | | | |
|---|---|---|---|---|
| EP | 534263 | A1 | * | 3/1993 |
| EP | 536088 | A1 | * | 4/1993 |
| EP | 1717181 | A1 | | 2/2006 |
| GB | 2125072 | A | | 2/1984 |
| JP | 10136665 | A | * | 5/1998 |
| WO | 9114032 | A1 | | 9/1991 |
| WO | WO 9114032 | A1 | * | 9/1991 |
| WO | 0222483 | A1 | | 3/2002 |

OTHER PUBLICATIONS

CN Office Actionissued Apr. 21, 2015 re: Application No. 201210580870.1; pp. 1-19.

* cited by examiner

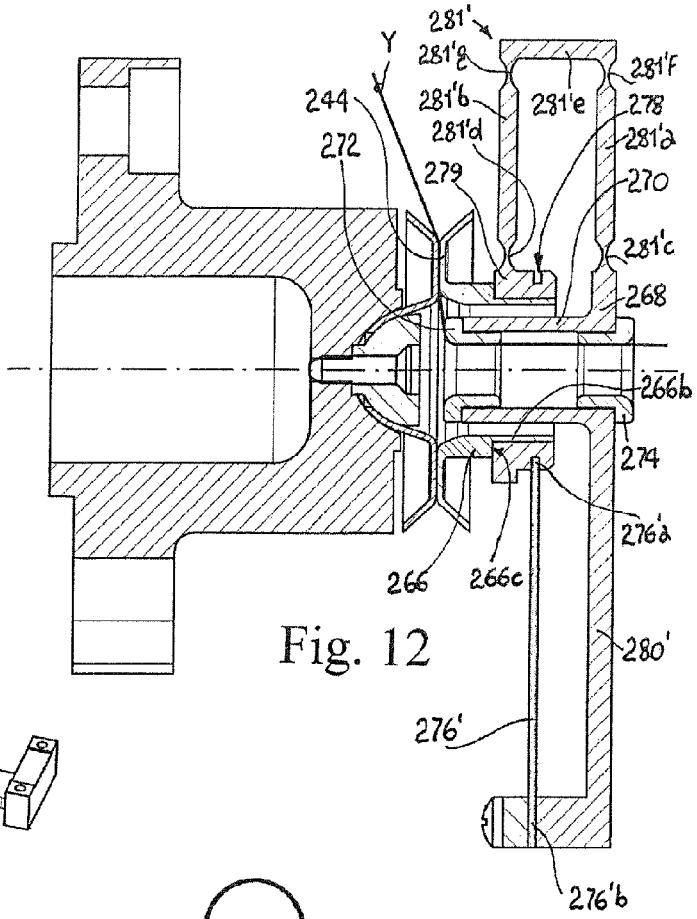
Fig. 12
Fig. 13
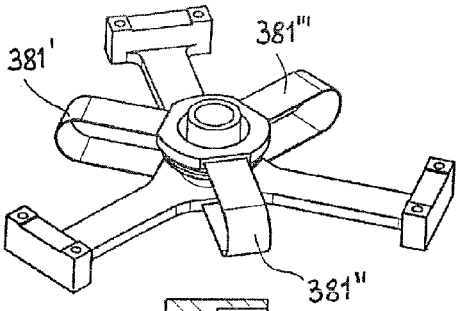
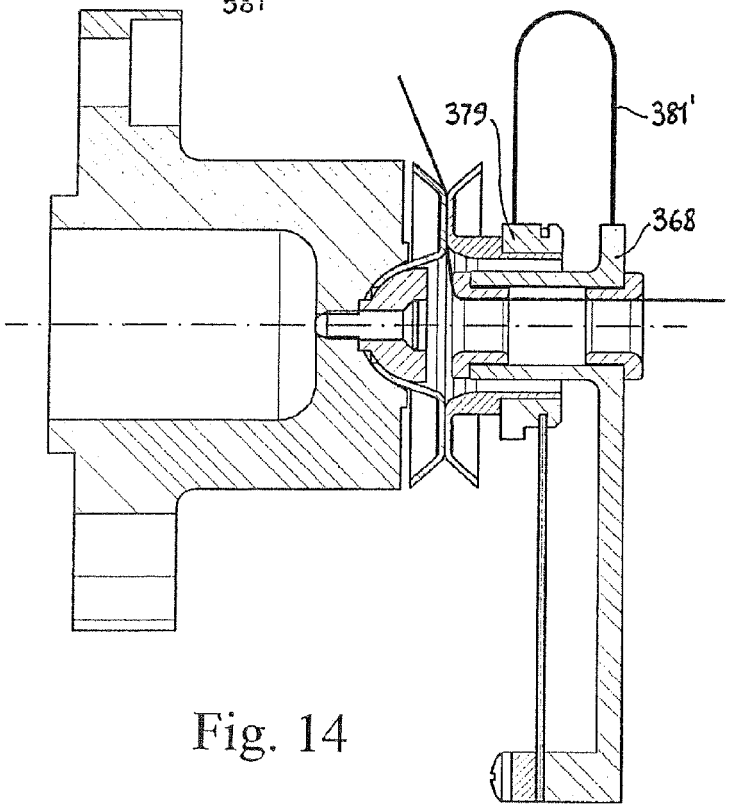
Fig. 14

WEFT-BRAKING DEVICE FOR YARN FEEDERS PROVIDED WITH A STATIONARY DRUM

The present invention relates to a weft-braking device for yarn feeders provided with a stationary drum.

BACKGROUND OF THE INVENTION

As known, a yarn feeder for textile/knitting lines typically comprises a stationary drum on which a motorized flywheel winds a plurality of yarn loops forming a well reserve. Upon request from a dowstream machine, e.g., a loom, the loops are unwound from the drum and, before reaching the machine, the yarn passes through a weft-braking device that influences the tension of the unwinding yarn.

WO91/14032 discloses a weft-braking device, in which the yarn unwinding from the drum radially runs between two counterposed annular plates which are coaxially arranged in front of the drum and are biased against each other in order to brake the yarn by friction. The plate facing the drum is stationary, while the opposite plate is biased against the stationary plate by a spring or an actuator, e.g., an electromagnetic actuator which is controlled in order to adjust the amount of braking action applied to the yarn.

In WO02/22483, the unwinding yarn also runs radially between two counterposed annular plates which are coaxially arranged in front of the drum. The plate facing the drum is made of a magnetic material and is axially slidable on a pin. The opposite plate is stationary and has an electromagnet arranged behind it which, when energized, attracts the movable plate against the stationary plate, whereby a braking action is applied to the yarn which depends on the current across the electromagnet.

An advantage of the above-mentioned braking systems is that they do not require frequent cleaning operations because the dust and paraffine generated by the yarn running between the braking surfaces are swept away by the swivel movement of the yarn unwinding from the drum.

However, the above-mentioned systems also have some drawbacks.

In particular, the electromagnetically operated braking systems, which are widespread nowadays, are not entirely satisfactory in terms of reaction times. Particularly, it is known that the excitation times of the coils are not negligible; in addition, in the case of WO02/22483, the movable plate made of a magnetic material has a relatively heavyweight structure, resulting in a considerable inertia which further slows down the reactivity of the system.

In addition, it is also known that the electromagnetically operated weft-braking devices require high currents and, consequently, high power, with consequent disadvantages in terms of energy consumption, especially in view of the fact that a conventional textile/knitting line often makes use of dozens of feeders for a single downstream machine.

SUMMARY OF THE INVENTION

Therefore, it is a main object of the present invention to provide a weft-braking device for yarn feeders with stationary drum which is easy to manufacture and, particularly with respect to systems which make use of electromagnetic actuators, has faster reaction times and operates with relatively low currents, in order to generally reduce the energy consumption.

The above object and other aims, which will better appear from the following description, are achieved by the weft-braking device having the feature recited in claim 1, while the dependent claims state other advantageous, though secondary, features of the invention.

BRIEF DESCRIPTION OF THE DRAWINGS

The invention will be now described in more detail with reference to a few preferred, non-exclusive embodiments, shown by way of non-limiting example in the attached drawings, wherein:

FIG. 12 is an axial, cross-sectional view of the weft-braking device of FIG. 10;

FIG. 13 is a perspective view showing a modified version of the component of FIG. 11 in a third alternative embodiment of the invention;

FIG. 14 is an axial, cross-sectional view similar to FIG. 12 but referring to the weft-braking device of FIG. 13;

DESCRIPTION OF THE PREFERRED EMBODIMENTS

Figure 1:
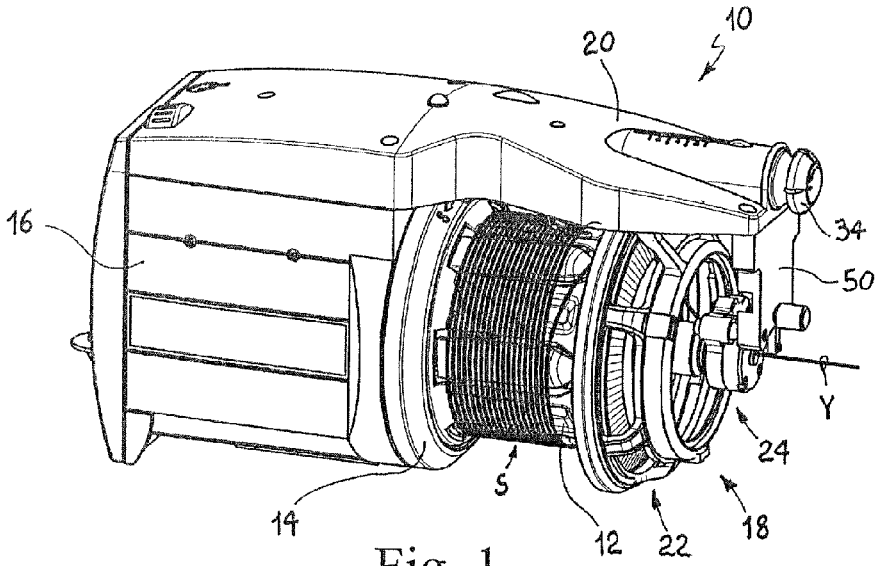
FIG. 1 is a perspective view of a yarn feeder provided with a stationary drum, on which a weft-braking device according to a first embodiment of the invention is installed.
Figure 2:
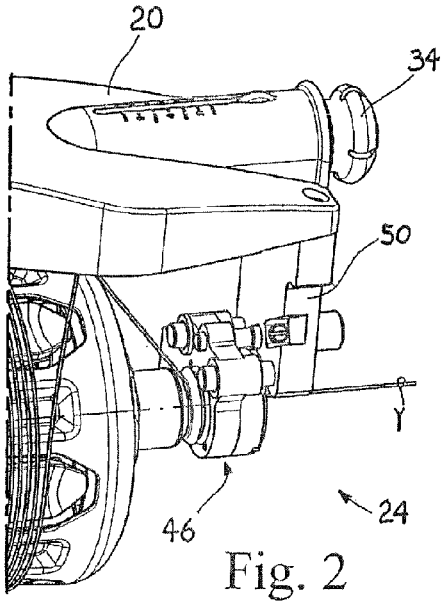
FIG. 2 is a perspective view of a portion of the yarn feeder of FIG. 1 from a different viewpoint.

With initial reference to FIG. 1, a yarn feeder 10 of the type referred to in the present invention comprises a stationary drum 12, on which a flywheel 14 driven by a motor 16 winds a plurality of loops of yarn Y forming a weft reserve S. Upon request from a downstream machine (not shown) such as a loom, the loops are unwound from drum 12 and pass through a brake unit 18 supported by an arm 20 projecting from the motor housing of the feeder. Brake unit 18 controls the tension of the yarn in order to maintain a desired value.

Brake unit 18 comprises a weft-braking device 22 of a conventional type (FIGS. 5, 6), which is adapted to apply a static braking action upon the unwinding yarn at the delivery edge 12*a* of drum 12, as well as an active weft-braking device 24 (FIGS. 2, 3, 5-7), which is adapted to apply a modulated braking action upon the yarn downstream of the first weft-braking device 22 and is the object of the invention, according to a first embodiment.

Static weft-braking device 22 comprises a hollow frustoconical member 26, which is biased with its inner surface against delivery edge 12*a* of drum 12 to pinch the unwinding yarn. Frustoconical member 26 is coaxially supported by a ring 27 which is anchored to an annular, cage-shaped support 28 fixed to a sled 30 (FIG. 6), the latter being longitudinally movable upon control of a screw mechanism 32 housed within arm 20, in a conventional way in the field. Screw mechanism 32 is manually operable by a knob 34 to adjust the pressure applied by hollow frustoconical member 26 to drum 12 and, consequently, the static braking action applied to the yarn.

Figure 7:
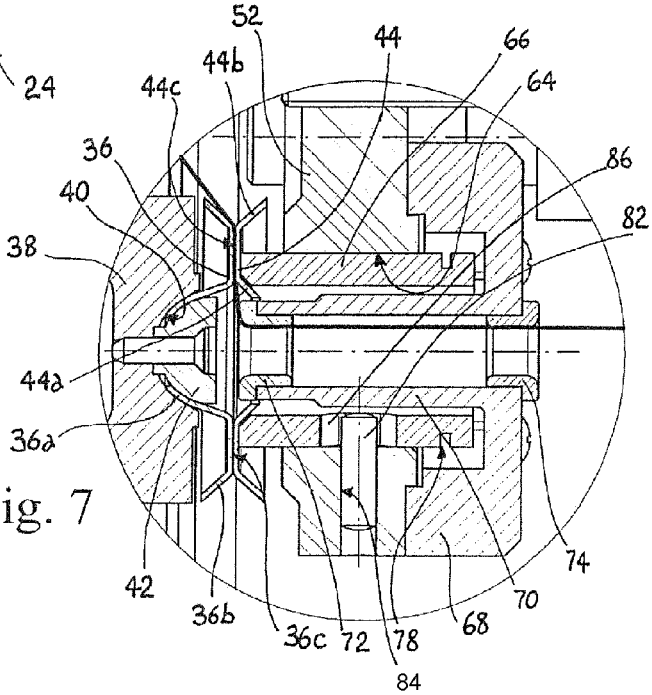
FIG. 7 shows a detail of FIG. 6 to an enlarged scale.

Active weft-braking device 24 comprises a pair of counterposed braking plates having a circular profile and coaxially supported in front of the delivery end of the drum, between which the unwinding yarn runs radially. A first one of said braking plates, 36, is mounted on a hollow cylindrical support 38 provided with a flange 38 at one end, via which it is coaxially fixed to the delivery edge of the drum. With particular reference to FIG. 7, the opposite end of cylindrical support 38 has a hemispherical seat 40, in which a drawn middle portion 36*a* of first plate 36, having a corresponding hemispherical profile, is received. Drawn middle portion 36*a* is axially sandwiched between hemispherical seat 40 and a counter-shaped member 42 which is axially screwed to the end of the cylindrical support, so that a spherical joint is provided which allows the plate to swing about a point lying on the axis of drum 12. An outer edge 36*b* of first braking plate 36 is obliquely bent towards drum 12. A flat, annular surface 36*c* is defined between drawn middle portion 36*a* and outer edge 36*b*.

Figure 3:
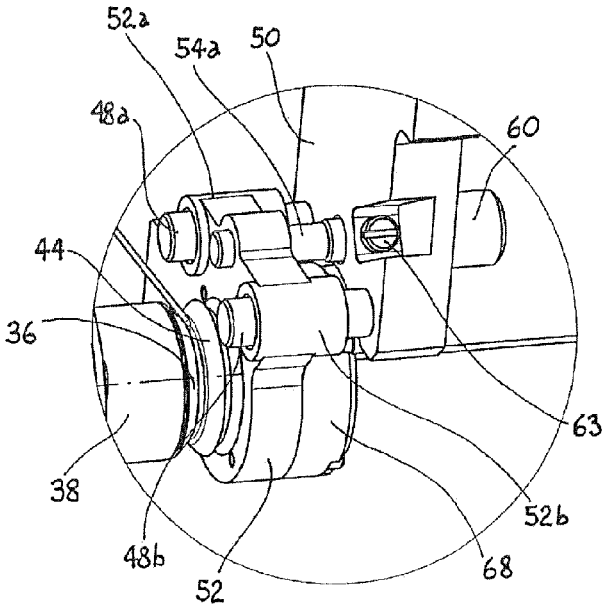
FIG. 3 shows a detail of FIG. 2 to an enlarged scale.
Figure 4:
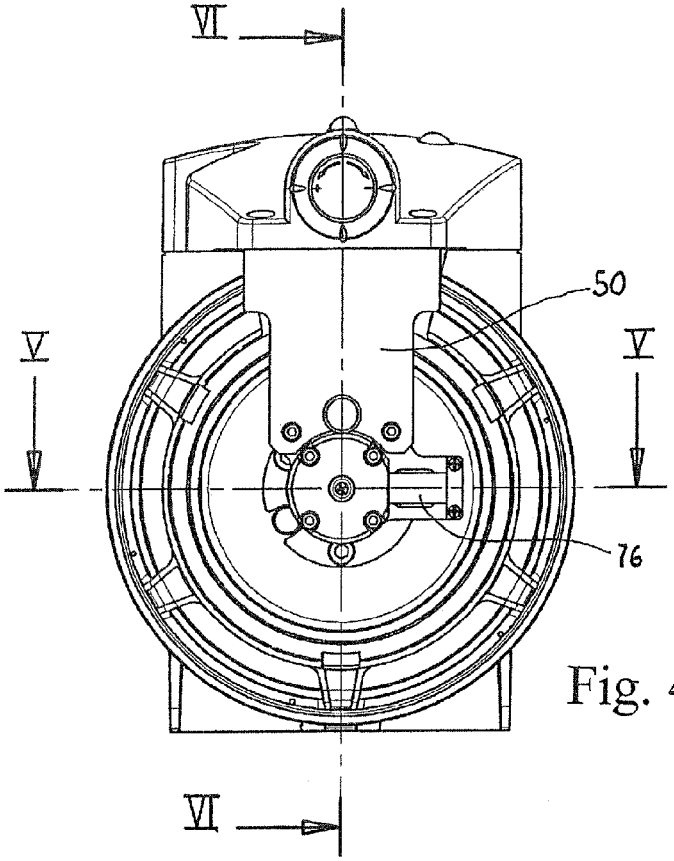
FIG. 4 is a front elevation view of the yarn feeder of FIG. 1.

A second braking plate 44 is coaxially arranged in front of first braking plate 36 and is connected to an axial driving device 46 supported by a pair of guide bars 48*a*, 48*b* (FIG. 3) projecting from a bracket 50 integral with arm 20 in a direction parallel to the axis of the drum. Axial driving device 46 comprises a support plate 52 provided with a pair of bushes 52*a*, 52*b* which slidably engage guide bars 48*a*, 48*b* upon control of a second screw mechanism (FIG. 3). The second screw mechanism (FIGS. 6, 7) comprises an actuating rod 54, which is pivotally received in a bore 56 of bracket 50 and is provided with a threaded end 54*a*, which engages a threaded hole 58 formed in support plate 52, as well as with an opposite, knob-shaped end 60, and with an intermediate groove 62 that is radially engaged by a screw 63 (FIG. 3) inserted into bracket 50 in order to prevent the actuating rod from moving axially. Accordingly, actuating rod 54 is manually operable by knob 60 to adjust the longitudinal position of axial driving device 46 as a function of the thickness of the yarn, as will be described in more detail later.

With particular reference to FIG. 7, support plate 52 has a through hole 64 coaxial to drum 12, in which a hollow rod 66 is slidably received. The end facing drum 12 of hollow rod 66 has second braking plate 44 anchored thereto. A circular cover 68 applied to the surface facing away from drum 12 of support plate 52, has a tubular projection 70 which axially extends into hollow rod 66. Tubular projection 70 has an inlet yarn-guide eyelet 72 and an outlet yarn-guide eyelet 74 received at its opposite ends.

Second braking plate 44 has an inner edge 44*a* and an outer edge 44*b* which are obliquely bent away from the drum, as well as a flat annular surface 44*c* defined between them which faces flat annular surface 36*c* of first braking plate 36. Inlet yarn-guide eyelet 72 has its inlet end almost aligned to flat annular surface 44*c* of second braking plate 44 when it is abutting on first plate 36.

Figure 5:
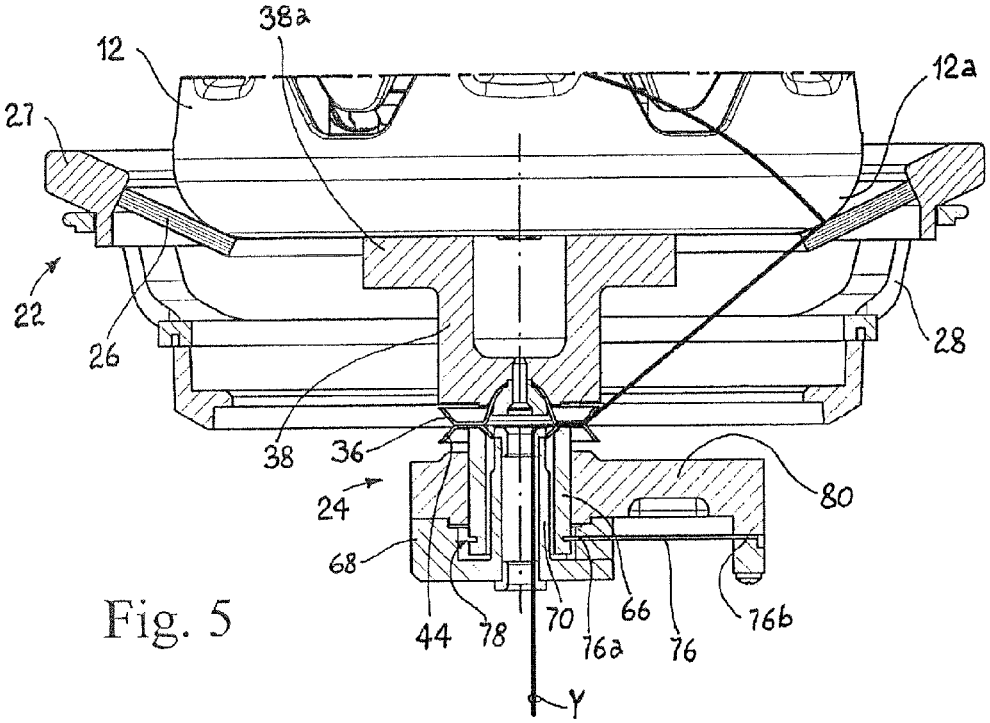
FIG. 5 is a cross-sectional view of FIG. 4 along line V-V.
Figure 6:
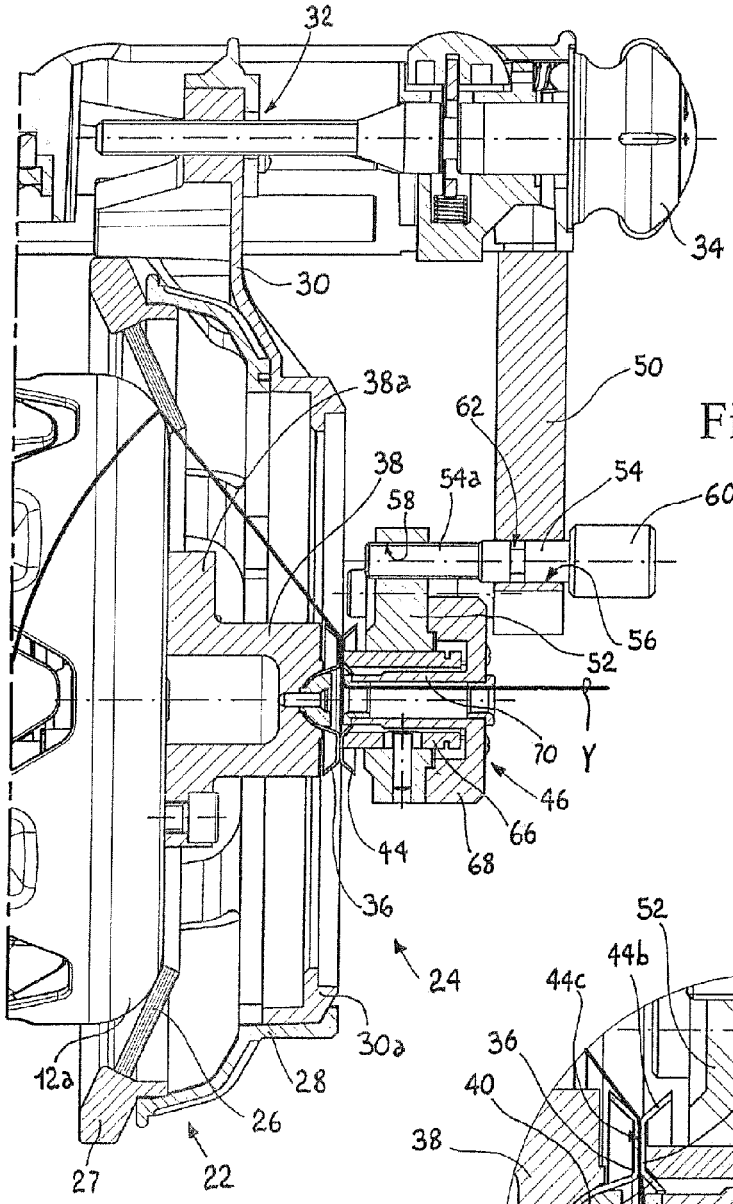
FIG. 6 is a cross-sectional view of FIG. 4 along line VI-VI.

With particular reference to FIG. 5, hollow rod 66 is axially movable upon control of a piezoelectric bending actuator 76 that is shaped as a rectangular plate adapted to bend in response to a voltage applied to it. Piezoelectric actuator 76 has an inner end 76*a* which engages a circumferential groove 78 formed on hollow rod 66, and an opposite, outer end 76*b* attached to the free end of an arm 80 which radially projects from support plate 46. Accordingly, when piezoelectric actuator 76 bends, it pushes rod 66—and consequently second braking plate 44 integral to the latter—towards first plate 36.

As shown in FIG. 7, a pin 82 inserted in a hole 84 of support plate 52 engages an opening 86 of hollow 66 for both locking the rotation of the rod and limiting its stroke in both directions.

Figure 8:
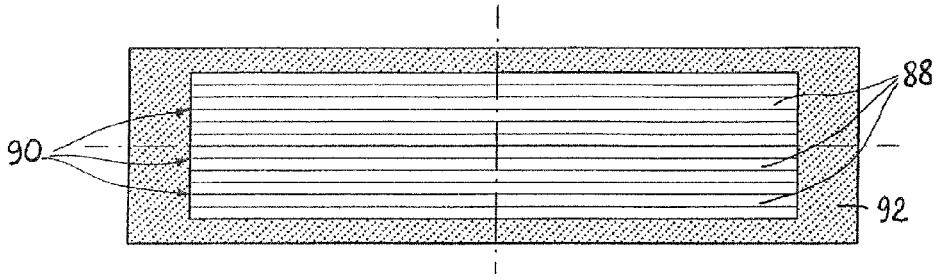
FIG. 8 is a transverse, cross-sectional view which separately shows a component of the weft braking device according to the invention.

FIG. 8 shows in detail a transverse cross section of piezoelectric actuator 76, which is preferably of a multilayer, monolithic type. As known, this type of piezoelectric actuator consists of a plurality of layers of a piezoelectric material 88 (typically, a ceramic material) alternating with layers of a conductive material 90, which act as electrodes for the actuator and are alternately positive and negative. All the layers are typically interconnected by sintering, and the stack of layers formed as above is provided with an outer lining 92 of an insulating material.

Alternatively, a piezoelectric actuator of the so-called "bimorph" type can be used, i.e., of the type comprising only two layers of piezoelectric material alternating with electrode layers.

The piezoelectric actuator is operaively connected to a control circuit (not shown) which is programmed to adjust the braking action in such a way as to maintain it constant on a predetermined value, e.g., by means of a control loop, either on the basis of signals received from a tension sensor arranged downstream of the yarn feeder, or on the basis of predetermined values, by means of techniques which are conventional in the field and, therefore, will not be further described.

The operation of the weft-braking device will be now described.

The yarn unwinding from drum 12 is first subject to a static braking action applied by static weft-braking device 22, which ensures the constant contact of the yarn with the delivery edge 12*a* of the drum. The yarn delivered from static weft-braking device 22 inserts between the outer edges 36*b* and 44*b* of plates 36, 44, runs between the counterposed annular surfaces 36*c*, 44*c*, comes out through the middle opening of second plate 44, is guided to enter tubular projection 70 by inlet eyelet 72, and finally is guided to exit tubular projection 70 by outlet eyelet 74. While running between the counterposed annular surfaces 36*c*, 44*c* of plates 36, 44, the yarn is subject to a second braking action depending on the voltage applied to piezoelectric bending actuator 76 which pushes second plate 44 against first plate 36. Such voltage is properly modulated by the control circuit as mentioned above, so that the yarn tension is maintained constant on a predetermined value.

As the person skilled in the art will appreciate, the yarn unwound from drum 12 radially slides between the counter-posed annular surfaces 36*c*, 44*c* of the plates and simultaneously rotates with a swivel movement that tangentially "sweeps" the annular surfaces and, consequently, keeps them clean.

Moreover, thanks to the position of inlet yarn-guide eyelet 72, the unwinding yarn does not apply any appreciable axial thrust to hollow rod 66 in the counter-braking direction, i.e., away from first plate 36. Therefore, the braking force is not affected by the tension of the yarn and can be modulated very accurately.

Using a monolithic, multilayer piezoelectric actuator instead of a piezoelectric actuator of a different type, e.g., an actuator having only two layers, is preferable, though not indispensable; in fact, as well known to the person skilled in the art, in the first case the thickness of each piezoelectric layer is lower by at least an order of magnitude, which circumstance, for equal voltage applyed to the single layer, ensures a stronger magnetic field and, consequently, a higher deformation. In addition, the multilayer technology offers higher performance in terms of sensibility and reactivity even at low voltage and is mechanically more reliable with respect to the technology based on two layers.

It has been found in practice that the reaction times of a piezoelectric system according to the invention can be even faster by one order of magnitude with respect to a conventional electromagnetic system.

Figure 9:
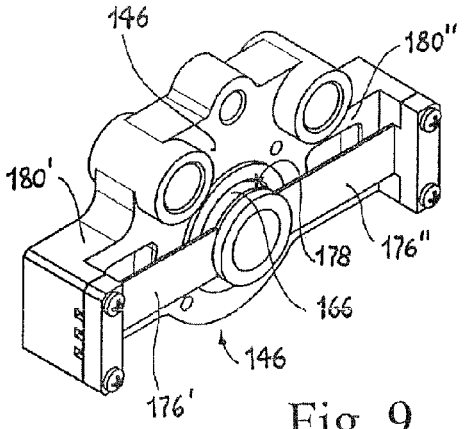
FIG. 9 is a perspective view of a weft-braking device for a yarn feeder provided with a stationary drum, in a first alternative embodiment of the invention.

In a first alternative embodiment of the invention, shown in FIG. 9, axial driving device 146 is provided with two piezoelectric bending actuators 176', 176" acting simultaneously on the hollow rod, thereby increasing the braking force. The piezoelectric actuators 176', 176" are connected to respective forked arms 180', 180" projecting radially from support plate 146 to diametrically opposite directions, and engage circumferential groove 178 of hollow rod 166 at opposed positions.

Figure 10:
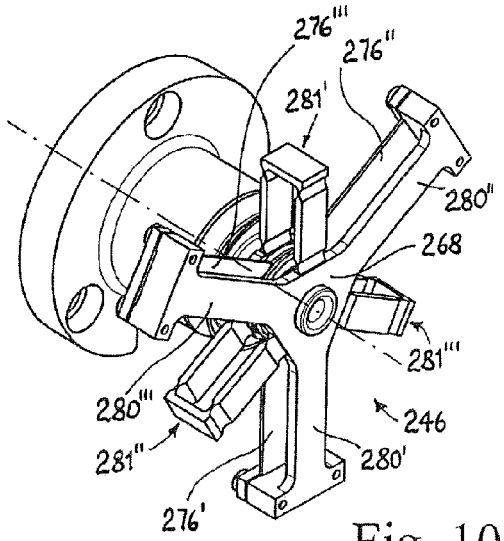
FIG. 10 is a perspective view of a weft-braking device for a yarn feeder provided with a stationary drum, in a second alternative embodiment of the invention.
Figure 11:
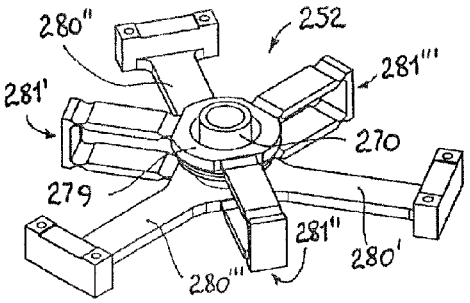
FIG. 11 is a perspective view which separately shows a component of the weft-braking device of FIG. 10.

In a second alternative embodiment shown in FIGS. 10-12, axial driving device 246 is provided with three piezoelectric bending actuators 276', 276", 276'" acting simultaneously on hollow rod 266, in order to further increase the braking force applied to yarn Y. With this embodiment, axial driving device 246 comprises a support member 252 (shown separately in FIG. 11) having a rigid middle portion 268 provided with a tubular projection 270 which axially extends into hollow rod 266 and, similarly to the previous embodiments, has an inlet eye-guide eyelet 272 and an outlet eye-guide eyelet 274 received at its opposite ends. Three equally-spaced rigid arms 280', 280", 280'" projecting radially from middle portion 268 have their free ends attached to the outer ends such as 276'*b* (FIG. 12) of the piezoelectric bending actuators 276', 276", 276'". The inner ends such as 276' of the piezoelectric bending actuators 276', 276", 276'" engage a circumferential groove 278 of a sleeve 279; the latter being monolithically connected to middle portion 268 via three radial counter-arms 281', 281", 281'", which are equally-spaced at diametrically opposite positions with respect to rigid arms 280', 280", 280'", and are designed to be yielding in the longitudinal direction. To this purpose, each of the counter-arms 281', 281", 281'" has a structure which is kinematically similar to an articulated quadrilateral, with two radial arms 281'*a*, 281'*b* (FIG. 12) which are mutually spaced in the axial direction and have their inner ends monolithically connected in a yielding manner to middle portion 268 and to sleeve 279 respectively, via respective thinned portions 281'*c*, 281'*d* acting as hinges. The outer ends of radial arms 281'*a*, 281'*b* are interconnected by a longitudinal arm 281'*e* via further thinned portions 281'*f*, 281'*g*.

Second plate 244 is monolithically connected to the end facing first plate 236 of hollow rod 266. The opposite end narrows into a neck 266*b* defining an annular abutment 266*c*, which is firmly received within sleeve 279.

With this embodiment, the axial movement applied by piezoelectric bending actuators 276', 276", 276'" to second plate 244 via hollow rod 266 and sleeve 279 is guided by the three yielding counter-arms 281', 281", 281'".

A third alternative embodiment shown in FIGS. 13, 14 differs from the last one only in that each of the three yielding counter-arms 381', 381", 381'" consists of an U-bent flexible plate, e.g., a metal plate, which has one end connected to middle portion 368 and the opposite end connected to sleeve 379.

Figure 15:
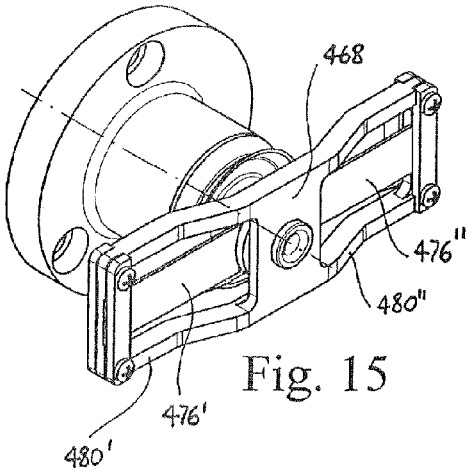
FIG. 15 is a perspective view of a weft-braking device for a yarn feeder provided with a stationary drum, in a fourth alternative embodiment of the invention.
Figure 17:
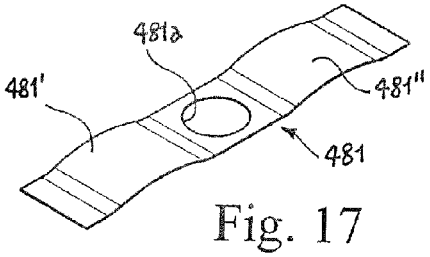
FIG. 17 is a perspective view which separately shows a component of the weft-braking device of FIG. 15.
Figure 16:
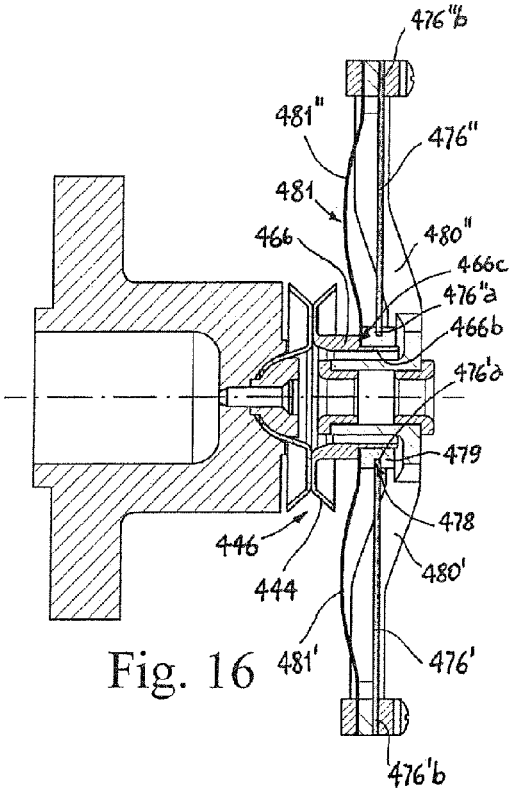
FIG. 16 is an axial, cross-sectional view of the weft-braking device of FIG. 15.

A fourth alternative embodiment is shown in FIGS. 15-17, which differs from the previous embodiments in the following features.

Axial driving device 446 is provided with two piezoelectric bending actuators 476', 476", which have their outer ends 476'*b*, 476"*b* connected to the outer ends of respective rigid forked arms 480', 480" projecting radially from a middle portion 468 to diametrically opposite directions. In addition, hollow rod 466 (which is identical to the one of the last embodiment) is supported by a flexible band 481, e.g., a metal plate, which is separately shown in FIG. 17, so that it can swing axially. Flexible band 481 has a middle opening 481*a* in which the narrow end portion 466*b* of hollow rod 466 is inserted, and two opposite, pre-bent wings 481', 481" which are attached to the ends of rigid arms 480', 480" on the side opposite to the actuators. Flexible band 481 is sandwiched between annular abutment 466*c* of hollow rod 466 and a nut 479 which is provided with a circumferential groove 478 engaged by the inner ends 476'*a*, 476"*a* of piezoelectric actuators 476', 476".

Figure 18:
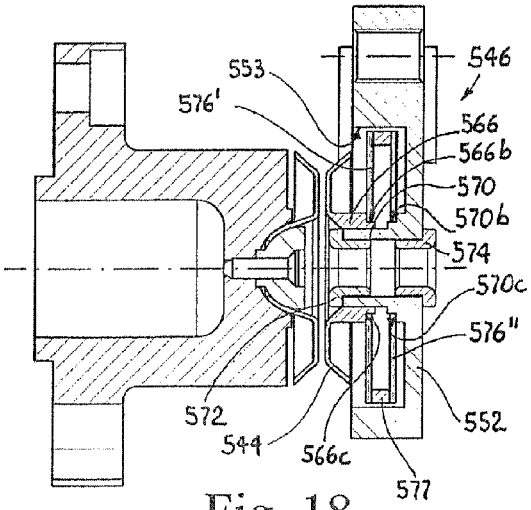
FIG. 18 is an axial, cross-sectional view of a weft-braking device for a yarn feeder provided with a stationary drum, in a fifth alternative embodiment of the invention.
Figure 19:
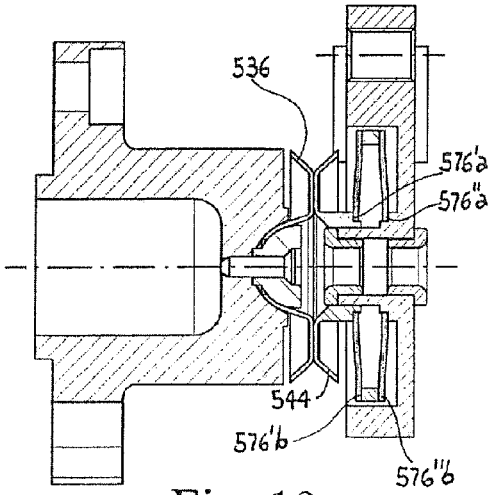
FIG. 19 is a view similar to FIG. 18 which shows the weft-braking device in a different operative configuration.

FIGS. 18, 19 show a fifth alternative embodiment, in which axial driving device 546 comprises a support plate 552 which is arranged at right angles to the axis of drum 12 and has a depression 553 on its surface facing the drum. A tubular projection 570 axially projects from the bottom of depression 553 and, similarly to the previous embodiments, has an inlet yarn-guide eyelet 572 and an outlet yarn-guide eyelet 574 respectively received at its opposite ends. A hollow rod 566 is slidable on the tubular projection and has second plate 544 monolithically connected to its end facing drum 12. Hollow rod 566 is axially movable upon control of a pair of counter-posed, annular piezoelectric bending actuators 576', 576" having a spacer ring 577 sandwiched between their outer edges. One of the actuators 576' engages a groove 566*b* formed at the end of hollow rod 566 facing away from second plate 544, and abuts against the annular abutment 566*c* defined by the groove itself. The other actuator 576' engages an annular step 570*b* formed at the end of tubular projection 570*b* connected to the bottom of depression 553 and abuts against a respective annular abutment 570*c* defined by the step itself.

As known, an annular piezoelectric bending actuator may have a layered structure similar to a piezoelectric bending actuator having a rectangular profile, e.g., and preferably, a monolithic multilayer structure. When a voltage is applied, the annular piezoelectric actuator bends as shown in FIG. 19, with its inner annular edge 576'*a*, 576"*a* and its outer annular edge 576'*a*, 576"*a* which axially move away from each other. Therefore, by arranging the actuators as shown in FIGS. 18, 19, i.e., in such a way that they bend to opposite directions, their activation causes second plate 544 to be biased against first plate 536.

Figure 20:
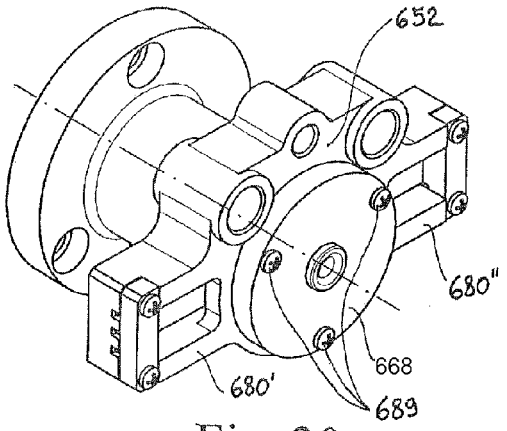
FIG. 20 is a perspective view of a weft-braking device for a yarn feeder provided with a stationary drum, in a sixth alternative embodiment of the invention.
Figure 21:
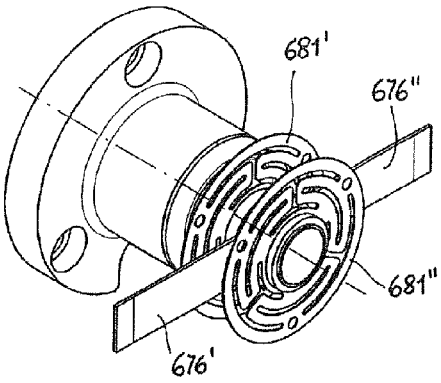
FIG. 21 is a view similar to FIG. 20, in which certain external components of the weft-braking device have been removed to show internal components.

FIGS. 20-23 show a sixth alternative embodiment of the invention, in which hollow rod 666 is supported by a pair of coaxial, annular elastic diaphragms 681', 681", which are received in a through opening 664 formed in a support plate 652 similar to the one shown in the second embodiment of FIG. 9. Also in this case, similarly to the embodiment of FIG. 9, two piezoelectric bending actuators 676', 676" are provided, which are connected to respective forked arms 680', 680" projecting radially from support plate 646 to diametrically opposite positions. Second plate 644 is monolithically formed at the end facing first plate 636 of hollow rod 666. The opposite end narrows into a neck 666*b* defining an annular abutment 666*c*. Diaphragms 681', 681" are fitted on neck 666*b* of hollow rod 666, with interposition of a spacer 677, and are axially sandwiched between annular abutment 666*c* and a nut 669. The outer edges of diaphragms 681', 681" are locked in respective annular seats 683', 683" which are formed at the opposite ends of through opening 664, by a locking ring 685 and a cover 668 respectively, which are connected to each other by longitudinal screws 689 (FIG. 20).

Similarly to the first two embodiments, a tubular projection 670 projecting axially from cover 668 is inserted into hollow rod 666 and has an inlet yarn-guide eyelet 672 and an outlet yarn-guide eyelet 674 respectively received at its opposite ends. A circumferential groove 678 formed on spacer 677 is engaged by the inner ends of piezoelectric bending actuators 676', 676".

Figure 22:
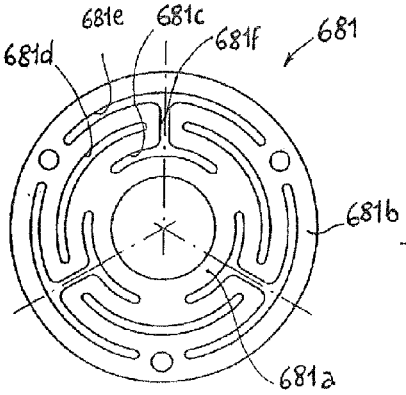
FIG. 22 is a plan view which separately shows a component of the weft-braking device of FIG. 20.
Figure 23:
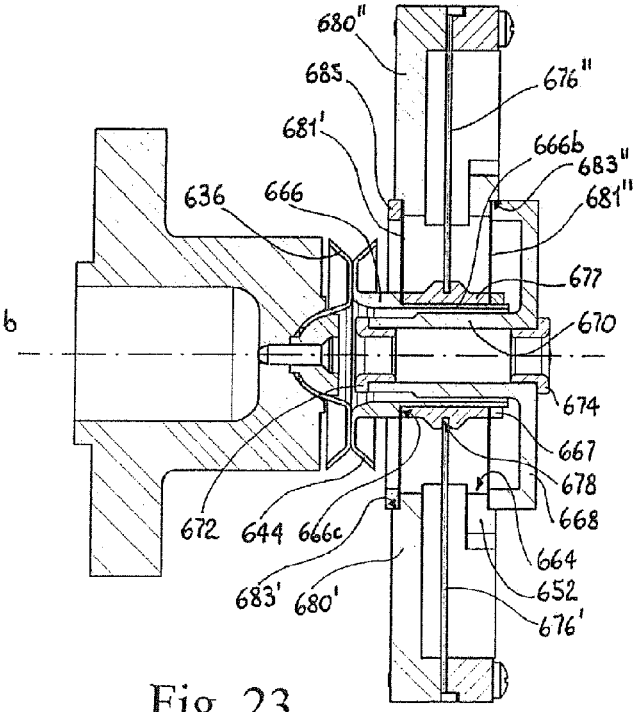
FIG. 23 is an axial, cross-sectional view of the weft-braking device of FIG. 20.

FIG. 22 separately illustrates an elastic diaphragm 681 of a conventional type as used in this embodiment. As shown, the diaphragm has an inner annular portion 681*a* and an outer annular portion 681*b* which are interconnected via a middle annular portion that is elastically yielding in virtue of concentric arched grooves, such as 681*c*, 681*d*, 681*e*, which are interconnected via alternate radial grooves 681*f*.

A few preferred embodiments of the invention have been described herein, but of course many changes may be made by a person skilled in the art within the scope of the claims. In particular, although piezoelectric bending actuators having a monolithic, multilayer structure are preferable, bimorph actuators (i.e., actuators having only two layers) could be sufficient for certain applications. Moreover, with all the above-described embodiments the movable, operative end of the piezoelectric actuator directly acts on the hollow rod (or on a body integral to the hollow rod) in a substantial longitudinal direction; however, depending on the circumstances, transmission means, as devised by the person skilled in the art, could be interposed. In addition, it should be understood that, with slight constructional changes, the piezoelectric actuator could have its inner end/edge fixed and push the plate with its outer end, contrary to what has been described in the above embodiments. Of course, the groove engaged by the operative end of the piezoelectric actuator in the above-described embodiments could be replaced by other engage means, e.g., hinges and the like, as devised by a person skilled in the art. Although some of the described embodiments do not show the connection between the brake driving means and arm 20, it is evident that simple adaptations, which will be obvious to a person skilled in the art, are required to use the same adjustable support system shown, e.g., in the first embodiment of FIGS. 1-7, with two bushes 52*a*, 52*b* integral to stationary support 52 and slidable on longitudinal guide bars 48*a*, 48*b* upon control of a screw mechanism or other conventional adjusting means. Moreover, the embodiments provided with three arms and three counter-arms could be modified to make use of only two, or four or even more, arms and/or counter arms.

The disclosures in Italian Patent Application No. TO2011A001217 from which this application claims priority are incorporated herein by reference.

What is claimed is:

1. A weft-braking device for installation on a yarn feeder provided with a stationary drum having a plurality of yarn loops wound thereon which are to be unwound upon request from a downstream machine, comprising:

a first annular plate coaxially supported in front of a delivery end of the drum, and a second annular plate which is coaxially biased against said first annular plate by driving means, said yarn being adapted to run between said annular plates to receive a braking action by friction from them, wherein said driving means comprise at least one piezoelectric actuator which is a flat, piezoelectric bending actuator deformable by bending in response to a voltage applied thereto and has a movable operative end which is operatively connected to said second annular plate and a stationary operative end which is anchored to a stationary support, wherein said piezoelectric actuator has an annular profile and is a multilayer, monolithical-type actuator formed by a plurality of layers made of a piezoelectric material alternated to layers of a conductive material, said layers being bonded to one another by sintering.

2. The device of claim 1, wherein said second annular plate has engaging means integral therewith, which are operatively engaged in a longitudinal direction by said movable operative end of the piezoelectric actuator.

3. The device of claim 1, wherein said second annular plate is coaxially fixed to a hollow rod which is slidably supported in the axial direction within a through hole formed in the stationary support.

4. The device of claim 1, further comprising two of said piezoelectric actuators acting at diametrically opposite positions.

5. The device of claim 1, wherein said second annular plate is coaxially fixed to a hollow rod shiftably supported in the axial direction by support means yielding in the axial direction.

6. The device of claim 5, wherein said support means yielding in the axial direction comprise at least two counter-arms yielding in the longitudinal direction, which are spaced at equal angles about the axis of the hollow rod and have their opposite ends respectively connected to a middle portion of said stationary support and to a sleeve supporting said hollow rod.

7. The device of claim 6, wherein each of said counter-arms is shaped as an articulated quadrilateral, with two radial arms mutually spaced in the longitudinal direction, which have their inner ends respectively connected in a yielding manner to said middle portion and to said sleeve, and their outer ends connected in a yielding manner to the opposite ends of a longitudinal arm.

8. The device of claim 6, wherein each of said counter-arms consists of a U-bent flexible foil having one end connected to said middle portion and the opposite end connected to said sleeve.

9. The device of claim 5, wherein said support means yielding in the axial direction comprise an elastically flexible band having a middle opening in which said hollow rod is supported, and two opposite ends which are attached to the ends of respective rigid arms projecting from said stationary support.

10. The device of claim 5, wherein said support means yielding in the axial direction comprise at least one annular elastic diaphragm at the middle of which said hollow rod is supported, which diaphragm is supported at its outer periphery by said stationary support.

11. The device of claim 1, wherein said annular profile is adapted to bend in such a way that its annular inner edge and its annular outer edge mutually move in the axial direction.

12. The device of claim 1, further comprising two counterposed of said annular piezoelectric actuators with a spacer ring sandwiched between their outer edges, said annular piezoelectric actuators being axially sandwiched with their inner edges between said second annular plate and said stationary support.

13. The device of claim 1, further comprising an axial tubular projection integral with said stationary support and passed through by said yarn, which has an inlet end facing the drum substantially aligned to the operative surface of said second annular plate when butted against said first annular plate.

14. The device of claim 13, wherein said second annular plate is coaxially fixed to a hollow rod slidably fitted to said tubular projection.

15. The device of claim 1, wherein said driving means are slidably supported on guide means extending parallel to the axis of the drum, at a longitudinal position adjustable upon control of adjusting means.

* * * * *